US005443015A

United States Patent [19]

Rudibaugh et al.

[11] Patent Number: 5,443,015

[45] Date of Patent: Aug. 22, 1995

[54] CENTER BOWL WEAR LINERS FOR RAILROAD CARS WITH VARYING HARDNESS VALUES

[75] Inventors: John W. Rudibaugh, West Chester; Charles L. Van Auken, Dillsburg, both of Pa.

[73] Assignee: Pennsy Corporation, West Chester, Pa.

[21] Appl. No.: 210,332

[22] Filed: Mar. 18, 1994

[51] Int. Cl.[6] ..... B61F 5/16

[52] U.S. Cl. ..... 105/199.4

[58] Field of Search ..... 105/199.4; 384/422

[56] References Cited

U.S. PATENT DOCUMENTS

| | | | |
|---|---|---|---|
| 1,781,253 | 11/1930 | Spencer . | |
| 2,258,640 | 10/1941 | Beckette . | |
| 3,405,565 | 10/1968 | De Valliere . | |
| 3,405,654 | 10/1968 | Dilg | 105/199.4 |
| 3,466,102 | 9/1969 | Goowyn . | |
| 3,570,409 | 3/1971 | Oelkers | 105/199.4 |
| 3,944,298 | 3/1976 | Cannon | 105/199.4 |
| 4,075,951 | 2/1978 | Chieric et al. | 105/199.4 |
| 4,112,851 | 9/1978 | Rousseau et al. | 105/199.4 |
| 4,222,331 | 9/1980 | Gage et al. | 105/199.4 |
| 4,241,667 | 12/1980 | Wulff | 105/199.4 |
| 4,289,077 | 9/1981 | Kleykamp et al. | 105/199.4 |

*Primary Examiner*—Robert J. Oberleitner
*Assistant Examiner*—S. Joseph Morano
*Attorney, Agent, or Firm*—John F. A. Earley; John F. A. Earley, III

[57] ABSTRACT

A wear liner for use in a railroad freight car between a truck bolster bowl and a car body center plate comprises a non-metallic wear liner bowl which has a horizontal bottom floor, and an upstanding circumferential side wall extending upwardly from the periphery of the bottom floor to a top flange which forms an upper rim. A sealing member extends outwardly from the upper rim and has an upper lip which extends outwardly and upwardly to contact a base shoulder of the center plate. The sealing member also has a lower lip that extends outwardly and downwardly to contact a top shoulder of the truck bolster bowl. The floor and circumferential side wall of the wear liner are made of a harder synthetic resin plastic material than the synthetic resin plastic material of which the softer sealing member is made. The composite sealing member lips are outboard of the side wall of the car body center plate and the truck bolster bowl so as to be out of the way when the center plate is being lowered into the truck bowl.

11 Claims, 3 Drawing Sheets

CENTER BOWL WEAR LINERS FOR RAILROAD CARS WITH VARYING HARDNESS VALUES

BACKGROUND OF THE INVENTION

1. Field of the Invention

This invention relates to wear liners for railroad cars, and more particularly concerns wear liners between car body center plates and truck bowls, and to wear liners which may be used with or without lubricants between the car body center plate and the truck bowl.

2. Description of the Prior Art

Conventional car body center plates and truck bowl combinations have used a polymer plastic liner between the center plate and the truck bowl. The polymer plastic liners have run into trouble in railroad freight classification hump yards where the freight cars are pushed off a hump to bump into the rear car of a freight train that is being made up. With the freight cars banging into each other like this, the synthetic resin plastic of the liner starts to extrude up between the car body center plate and the truck bowl.

A number of railroads currently grease the inside of truck bowls to provide a low coefficient of friction surface between the car body center plate and the truck bowl in order to permit freight cars to negotiate curves. But it is now being realized that grease does not stay in truck bowls very long because the load bearing pressures are very high, and the grease is being forced out of the truck bowl in a short period of time.

Other conventional wear liners comprise a flat metal plate which is seated on the floor of the truck bowl to provide a low coefficient of friction surface between the bottom of the truck bowl and the wear plate, and to provide a low coefficient of friction surface between the car body center plate and the flat wear liner. Such a wear liner may be held in place by a metal ring which is welded into a groove at about the juncture between the bottom wall of the truck bowl and the side wall of the truck bowl.

SUMMARY OF THE INVENTION

The present invention comprises a wear liner made of a synthetic resin plastic in the form of a bowl with a flat bottom or floor and an upstanding side wall, and with a top flange extending outwardly from the top of the side wall to form an upper rim. A seal member extends from the upper rim with an upper outer lip extending upwardly and outwardly for contacting the base or shoulder of a car body center plate and forming a seal, and an inner downwardly extending lip for contacting the top shoulder of the truck bowl and forming a seal. The material of the rim seal member is softer than the material of the floor and side wall of the wear liner so that the upper lip makes better sealing contact with the base of the car body center plate, and so that the lower lip makes better sealing contact with the top shoulder of the truck bowl. The hardness of the floor and side wall of the wear liner may typically be about 75 Duro D, whereas the hardness of the rim seal lips may typically be 90 Duro A.

The wear liner of the present invention may be provided with a metal ring positioned on the top flange or rim of the side wall of the wear liner, and this metal ring may be flat or it may have a flat horizontal surface and a downwardly extending flange.

Also, a steel keeper ring in the top shoulder of the truck bowl for prevents the side wall of the wear liner from extruding out of the space between the side wall of the truck bowl and the side wall of the car body center plate.

Recently, a number of railroads have begun using railcars which have articulated connectors that connect two railcars together and share a single truck. The car body center plates are designed differently from conventional center plates and this prevents our sealing member upper lip from having a center plate base shoulder to seal against.

Accordingly, one embodiment of the present invention includes a protective skirt which covers our sealing member and is attached to the car body center plate by a nylon cable tie which is wrapped around an upper upright portion of our skirt, and with an adhesive layer connecting the upright portion of the skirt to the car body center plate.

DETAILED DESCRIPTION OF THE DRAWINGS

Figure 1:
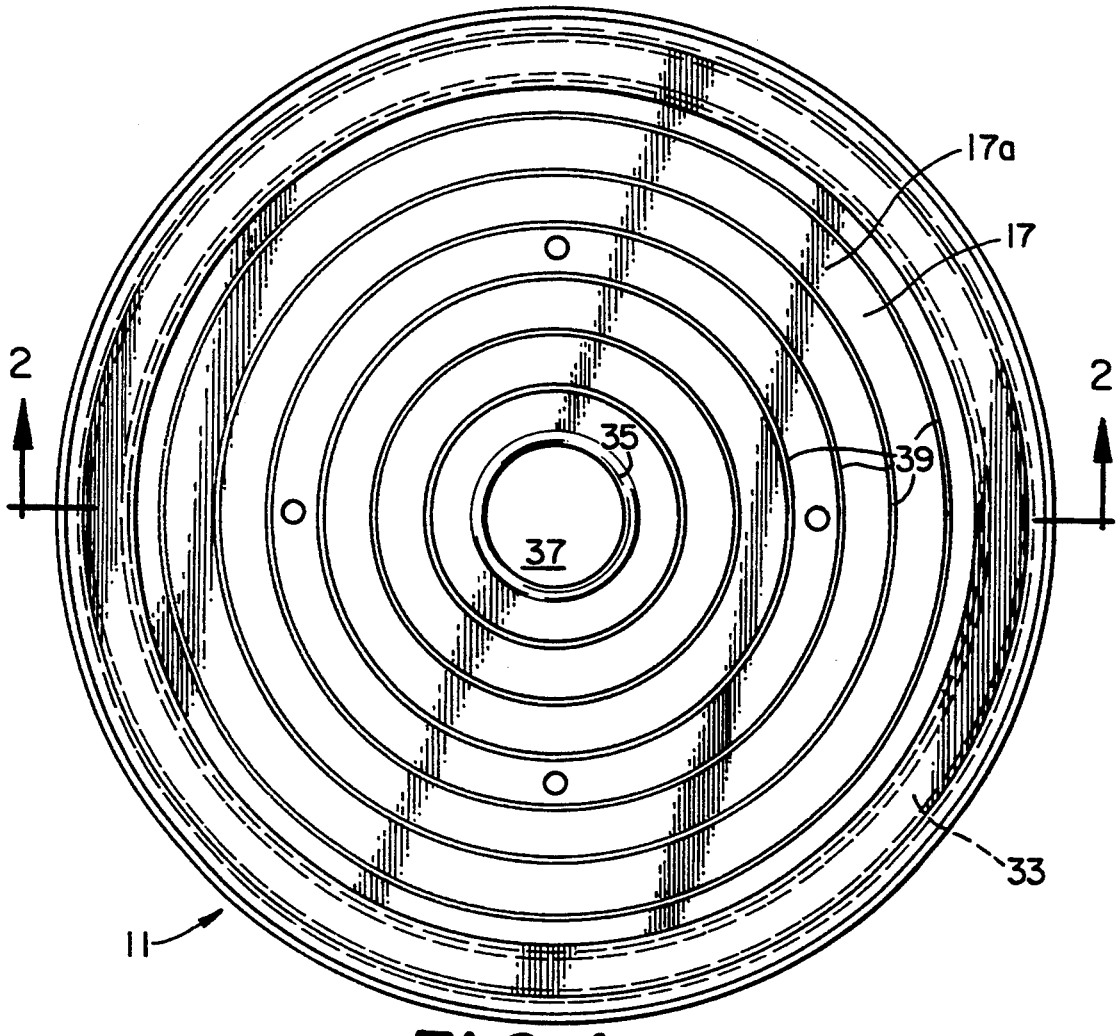
FIG. 1 is a view in top plan of a wear liner constructed in accordance with this invention.
Figure 2:
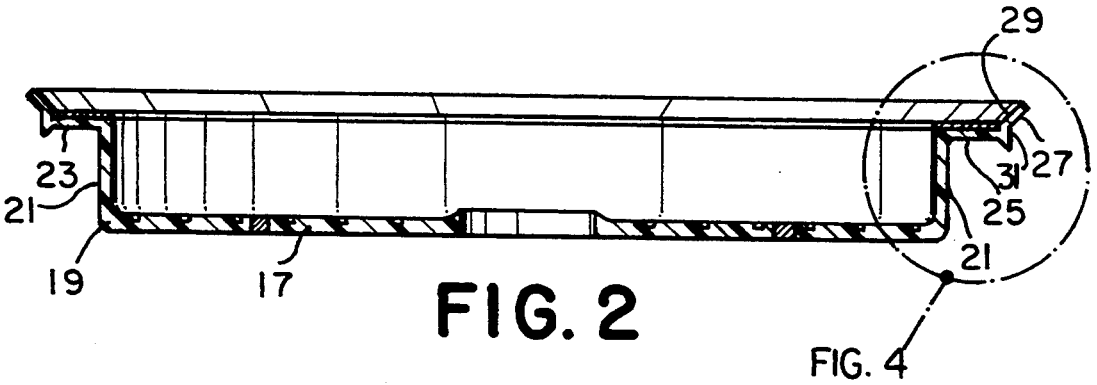
FIG. 2 is a view in section taken as indicated by the lines and arrows 2—2 which appear in FIG. 1.
Figure 3:
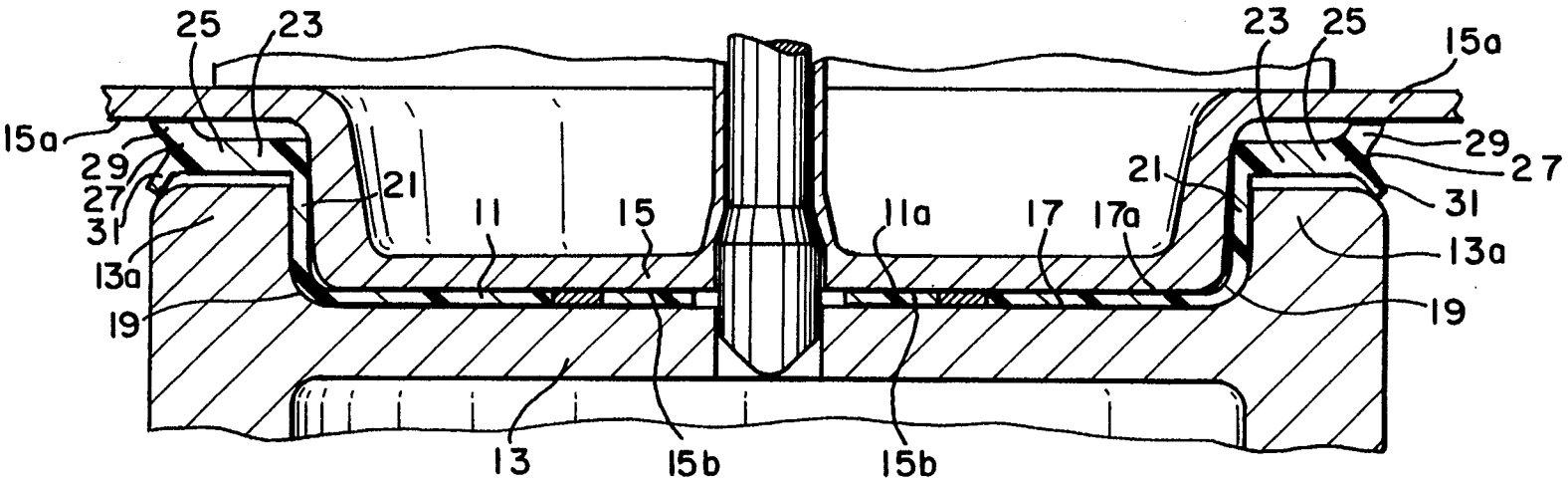
FIG. 3 is a view in section of the wear liner installed between a truck bowl and a car body center plate.
Figure 6:
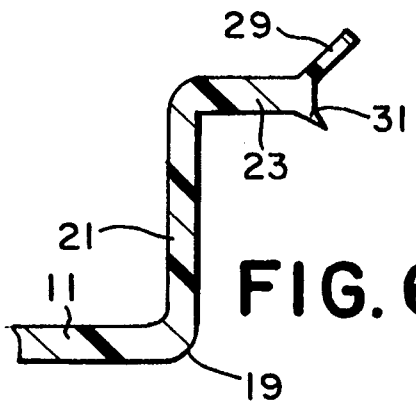
FIG. 6 is a view similar to FIGS. 4 and 5 and shows a wear liner without any metal ring on the side wall flange.

Turning now to the drawings, there is shown a wear liner 11 for use in a railroad car between a truck bowl 13 and a car body center plate 15 which comprises a wear liner bowl 11*a* that includes a horizontal bottom floor 17 having an outer periphery 19, and an upstanding circumferential side wall 21 that extends upwardly from the periphery 19 of the bottom floor 17 to a top flange 23 which forms an upper rim 25.

A sealing member 27 extends outwardly from the upper rim 25 and has an upper lip 29 that extends outwardly and upwardly to contact a base shoulder 15*a* of the center plate 15. Sealing member 27 is also provided with a lower lip 31 that extends outwardly and downwardly in order to contact a top shoulder 13*a* of the truck bowl 13.

A raised sealing ridge 35 is formed in the center of the floor 17 around a center hole 37 for holding a lubricant for lubricating the surfaces between bottom surface 15*b* of center plate 15 and top or upper surface 17*a* of the wear liner floor 17.

Circular grooves 39 are formed in the upper surface 17*a* of the wear liner floor 17 and grooves 39 hold lubricant and lubricate the bottom surface 15*b* of the center plate 15. If no lubricant is used, circular grooves 39 trap contaminants between the wear liner 11 and the bottom surface 15*b* of the center plate 15, and keep the contaminants off the wear surfaces.

Floor 17 and the circumferential side wall 21 of the wear liner 11 are made of a harder synthetic resin plastic material than the synthetic resin plastic material of which the softer sealing member 27 is made. This provides for better sealing between the softer sealing lip 29 and the car body center plate 15, and between the softer sealing lip 31 and the truck bowl 13 to prevent grit and grime from getting between the car body center plate 15 and the wear liner 11, and from getting between the truck bowl 13 and the wear liner 11.

Figure 4:
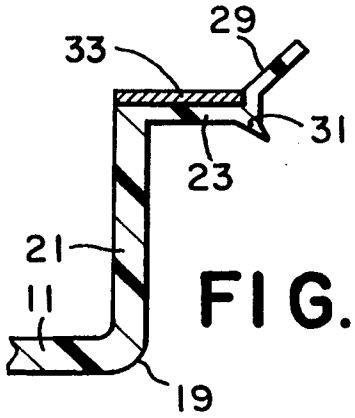
FIG. 4 is an enlarged view of the section indicated by the number 4 in FIG. 2 and shows the preferred embodiment of this invention with a flat steel ring mounted on the upper flange or rim of the side wall of the wear liner.

As shown in FIG. 1 and FIG. 4, a reinforcing metal ring 33 is provided on the top flange 23 of the wear liner for strengthening the wear liner when the car body center plate 15 is rocking in the truck bowl 13, and for protecting the wear liner 11 when the railroad car is being humped at a classification yard where trains are being made up. Reinforcing metal ring 33 also provides protection to the wear liner 11 when the center plate 15 is being lowered into the truck bowl 13.

Figure 5:
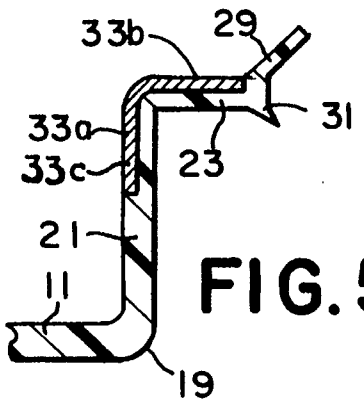
FIG. 5 is a view similar to FIG. 4 and shows a wear liner having a metal ring which has a flat portion and a flange extending downwardly therefrom that fits inside the bowl of the wear liner.

Metal ring 33 is flat. In another embodiment of FIG. 5, a metal ring 33*a* is provided wherein the top portion 33*b* is flat, and a downwardly extending flange 33*c* depends from flat portion 33*b* and fits inside the bowl of the wear liner.

The floor 17 and side wall 21 of the wear liner 11 have a hardness of about 70 Duro D, and the sealing member 27 has a hardness of about 90 Duro A.

The floor 17 and side wall 21 of the wear liner 11 is preferably made of about 95% castable thermosetting urethane and about 5% graphite powder by weight, such as L-315 Uniroyal Adiprene Castable Thermoset Urethane mixed with 5% by weight of commercial graphite powder.

The sealing member 27 is preferably made of L-100 Uniroyal Adiprene Castable Thermoset Urethane.

Other urethane materials are available from other sources offering equivalent properties in castable thermoset or in thermoplastics. Sealing member 27 is flexible and elastomeric urethane is desirable, but rubber may be an alternative. Thermoplastic materials such as styrenic block copolymers, polyolefin blends, thermoplastic copolyesters, and polyamides such as Hytrel by DuPont, may be used in the wear liner 11.

Figure 7:
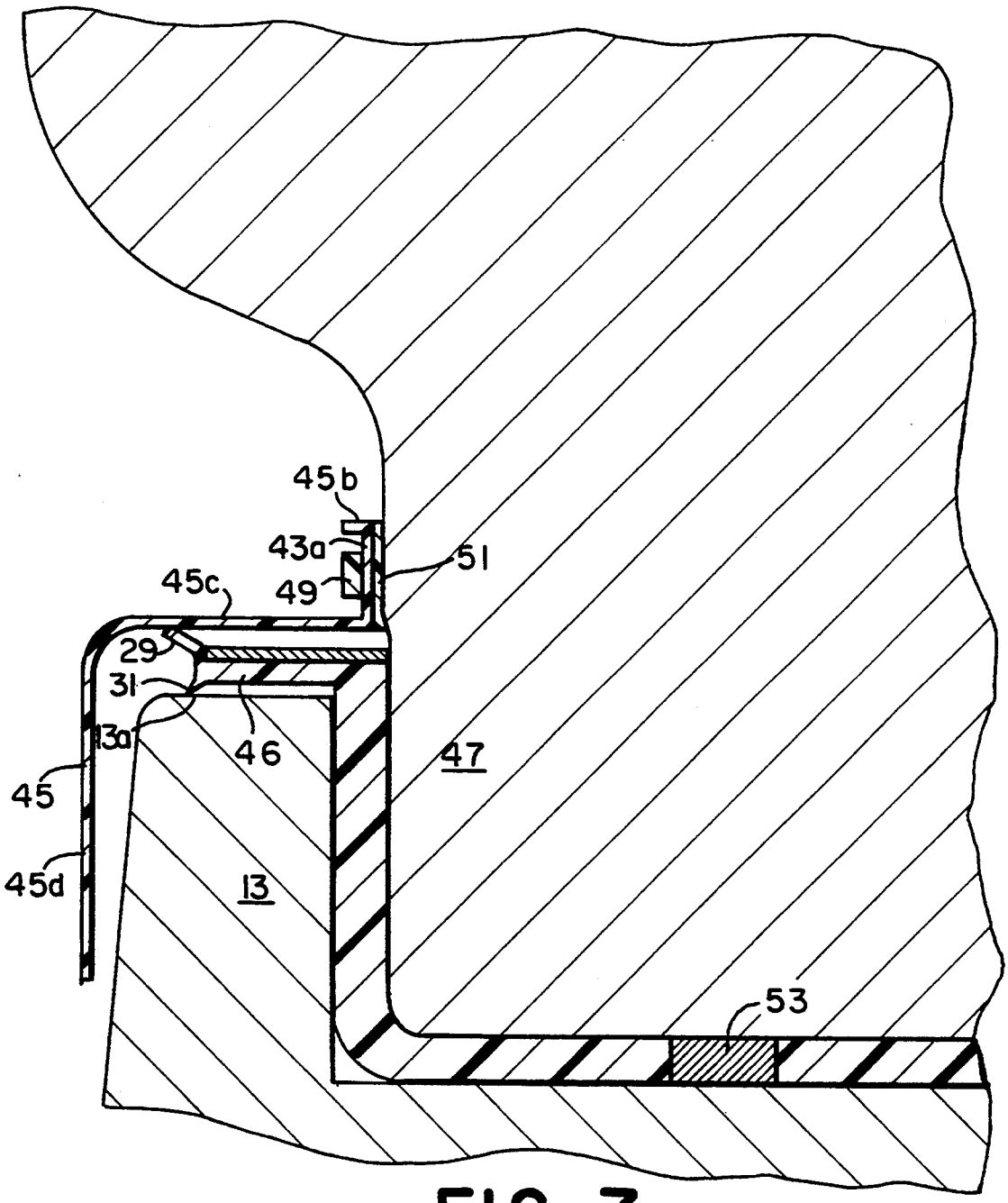
FIG. 7 is a view in section showing another embodiment of the invention which is adapted for use with an articulated railroad car.

Turning now to FIG. 7 there is shown an embodiment of the invention which includes a protective skirt 45 that covers the sealing member 46. Protective skirt 45 may be mounted on the car body center plate 47 of an articulated railroad car by a nylon cable tie 49 wrapped around an upright portion 45*a* of the skirt 45. An adhesive layer 51 also connects the upright portion 45*a* of the protective skirt 45 to the center plate 47 of the articulated railroad car.

Protective skirt 45 is preferably made of extruded PVC polymer and may be 51¼ inches long. The adhesive layer 51 may be a butyl adhesive, and the nylon cable ties 49 may be two in number. Protective skirt 45 includes an upper flange 45*b* which extends from the top of the upright portion 45*a*, a horizontal portion 45*c* which extends outwardly from the bottom of upright portion 45*a*, and a downwardly extending portion 45*d* which extends downwardly from the outer edge of horizontal portion 45*c*. Since the materials of the wear liner 11 are nonconductive, metallic plugs 53 are provided to ground the center plate 15 to the truck bowl 13 and prevent buildups of static charges.

In operation, the seals of lips 29 and 31 are sealed against horizontal portions or shoulders of the truck bowl 13 and the center plate 15. In the embodiment of FIG. 7, the upper seal lip 29 seals against the bottom of horizontal portion 45*c* of the protective skirt 45 and the lower seal lip 31 seals against the top shoulder 13*a* of the truck bowl 13.

In conventional wear liners, the seals are made between the vertical portion of the truck bowl 13 and the vertical portion of the center plate 15, and this may cause problems.

Besides providing a better seal, the sealing lips 29, 31 are protected and are out of the way of the center plate 15 as it is being lowered into the truck bowl 13 and thus avoid the danger of being pinched between them and ruined.

ADVANTAGES

The present invention has an upper top rim 25 with a seal member 27 extending therefrom having an upwardly and outwardly extending lip 29 and a downwardly and outwardly extending lip 31. Upper sealing lip 29 seals the wear liner 11 to the base shoulder 15*a* of the car body center plate 15, and lower sealing lip 31 seals the wear liner 11 to the top shoulder 13*a* of the truck bowl 13.

Wear liner 11 is made of a composite polymer material, i.e., a soft polymer for the sealing lips 29 and 31, and a very hard durable polymer for the floor 17 and upstanding side wall 21 of the wear liner 11.

The upper sealing lip 29 is located outboard of the center plate 15 which allows for continuous contact between the upper lip 29 and the base shoulder 15*a* of the center plate 15 during railcar rocking. The soft polymer material used in the upper sealing lip 29 allows for better contact and compliance with the generally rough casting surface of the base shoulder 15*a* of the car body center plate 15. Also, the soft polymer material used in the lower sealing lip 31 allows for better contact and compliance with the generally rough casting surface of the top shoulder 13*a* of the truck bowl 13.

Further, and very important, the upper seal 29 being outboard of the truck bowl 13 permits the railcar to be assembled, and the center plate 15 inserted into the truck bowl 13, without the sealing lips 29 being pinched and torn and rendered ineffective.

The lower seal 31 is also made from a soft polymer and seals against the top of the truck bowl shoulder 13*a*, providing good contact and an effective seal.

The polymer of the floor 17 and side wall 21 of the wear liner 11 has a very low coefficient of friction which is preferably enhanced by a commercial graphite powder which is 5% by weight of the polymer-graphite mix.

The polymer of the wear liner 11 being self-lubricating, it eliminates the need for grease. However, some railroads still use grease. Therefore, the wear liners 11 are provided with circular grooves 39 in the top surface of its floor 17 to retain grease. Through a wicking action, the grease is pulled from the grooves 39 onto the horizontal top surface 17*a* of the floor 17, thus providing grease to the sliding surfaces between the bottom surface 15*b* of the car body center plate 15 and the upper surface 17*a* of the floor 17 of the wear liner 11.

If grease is not used, then the grooves 39 perform another important function by collecting dirt that might have penetrated the seal lips 29, and would be wiped off the wear surface of the liner 11 and collected in the grooves 39. This allows the wear surface of the liner 11 to remain clean and extends the life of the wear liner.

We claim:

1. A wear liner (11) for use in a railroad car between a truck bowl (13) and a car body center plate (15), comprising a wear liner bowl (11*a*) made of synthetic resin plastic material, including a horizontal bottom floor (17) having an outer periphery (19), an upstanding circumferential side wall (21) extending upwardly from the periphery (19) of the bottom floor (17) to a top flange (23) which forms an upper rim (25), a sealing member (27) extending outwardly from the upper rim (25) having an upper lip (29) extending outwardly and upwardly for contacting a base shoulder (15*a*) of the center plate 15, said sealing member (27) having a lower lip (31) extending outwardly and downwardly for contacting a top shoulder (13*a*) of the truck bowl (13), said floor (17) and circumferential side wall (21) of the wear liner (11) being made of a harder synthetic resin plastic material than the synthetic resin plastic material of which the softer sealing member (27) is made.

2. The wear liner of claim 1, including a reinforcing metal ring (33) on the top flange (23) of the wear liner for strengthening the wear liner when the car body center plate (15) is rocking in the truck bowl (13).

3. The wear liner of claim 2, wherein the metal ring (33) is flat.

4. The wear liner of claim 2, wherein the metal ring (33*a*) has a flat portion and has a depending downwardly extending flange (33*c*) that fits inside the bowl (11*a*) of the wear liner.

5. The wear liner of claim 1, wherein the floor (17) and side wall (21) of the wear liner (11) have a hardness of about 70 Duro D, and the sealing member (27) has a hardness of about 90 Duro A.

6. The wear liner of claim 1, wherein the floor and side wall of the wear liner is made of about 95% castable thermosetting urethane and about 5% graphite powder by weight, and the sealing member (27) is made of castable thermosetting urethane.

7. The wear liner of claim 1, including a raised seal ridge (35) formed in the center of the floor (17) around the center hole (37) for holding lubricant for lubricating the surfaces between the bottom surface (15*b*) of the center plate (15) and the top surface (17*a*) of the wear liner floor (17), and circular grooves (39) in the upper surface (17*a*) of the wear liner floor (17) for holding lubricant and lubricating the bottom surface (15*b*) of the center plate (15) or for trapping contaminants between the wear liner (11) and the bottom surface (15*b*) of the center plate (15) if no lubricant is used.

8. The wear liner of claim 1, including a protective skirt (45) covering the sealing member (27), and means attaching the protective skirt (45) to the car body center plate (47).

9. The wear liner of claim 8, said attaching means comprising a nylon cable tie (49) wrapped around an upper upright portion (45*a*) of the skirt, and an adhesive layer connecting said upright portion to the car body center plate.

10. A wear liner (11) for use in a railroad car between a truck bowl (13) and a car body center plate (15), comprising a wear liner bowl (11*a*) made of a synthetic resin plastic material, including a horizontal bottom floor (17) having an outer periphery (19), an upstanding circumferential side wall (21) extending upwardly from the periphery (19) of the bottom floor (17) to a top flange (23) which forms an upper rim (25), a sealing member (27) extending outwardly from the upper rim (25) having an upper lip (29) extending outwardly and upwardly for contacting a base shoulder (15*a*) of the center plate 15, said sealing member (27) having a lower lip (31) extending outwardly and downwardly for contacting a top shoulder (13*a*) of the truck bowl (13), a raised seal ridge (35) formed in the center of the floor (17) around a center hole (37) for holding lubricant for lubricating the surfaces between the bottom surface (15*b*) of the center plate (15) and the top surface (17*a*) of the wear liner floor (17), and circular grooves (39) in the upper surface (17*a*) of the wear liner floor (17) for holding lubricant and lubricating the bottom surface (15*b*) of the center plate (15) or for trapping contaminants between the wear liner (11) and the bottom surface (15*b*) of the center plate (15) if no lubricant is used, said floor (17) and circumferential side wall (21) of the wear liner (11) being made of a harder synthetic resin plastic material than the synthetic resin plastic material of which the softer sealing member (27) is made, whereby the softer sealing member lips (29, 31) seal against the car body center plate (15) and the truck bowl (13) to prevent grit and grime from getting between the car body center plate (15) and the wear liner (11) and from getting between the truck bowl (13) and the wear liner (11), a reinforcing metal ring (33) on the top flange (23) of the wear liner for strengthening the wear liner when the car body center plate (15) is rocking in the truck bowl (13)

wherein the floor (17) and side wall (21) of the wear liner (11) have a hardness of about 70 Duro D, and the sealing member (27) has a hardness of about 90 Duro A, and wherein the floor and side wall of the wear liner is made of about 95% castable thermosetting urethane and about 5% graphite powder by weight, and the sealing member (27) is made of castable thermosetting urethane.

11. A wear liner (11) for use in a railroad car between a truck bowl (13) and a car body center plate (15), comprising a wear liner bowl (11*a*) made of a synthetic resin plastic material, including a horizontal bottom floor (17) having an outer periphery (19), an upstanding circumferential side wall (21) extending upwardly from the periphery (19) of the bottom floor (17) to a top flange (23) which forms an upper rim (25), a sealing member (27) extending outwardly from the upper rim (25) having an upper lip (29) extending outwardly and upwardly for contacting a base shoulder (15*a*) of the center plate 15, said sealing member (27) having a lower lip (31) extending outwardly and downwardly for contacting a top shoulder (13*a*) of the truck bowl (13), a raised seal ridge (35) formed in the center of the floor (17) around a center hole (37) for holding lubricant for lubricating the surfaces between the bottom surface (15*b*) of the center plate (15) and the top surface (17*a*) of the wear liner floor (17), and circular grooves (39) in the upper surface (17*a*) of the wear liner floor (17) for holding lubricant and lubricating the bottom surface (15*b*) of the center plate (15) or for trapping contaminants between the wear liner (11) and the bottom surface (15*b*) of the center plate (15) if no lubricant is used, said floor (17) and circumferential side wall (21) of the wear liner (11) being made of a harder synthetic resin plastic material than the synthetic resin plastic material of which the softer sealing member (27) is made, a reinforcing metal ring (33) on the top flange (23) of the wear liner for strengthening the wear liner when the car body center plate (15) is rocking in the truck bowl (13), wherein the floor (17) and side wall (21) of the wear liner (11) have a hardness of about 70 Duro D, and the sealing member (27) has a hardness of about 90 Duro A, wherein the floor and side wall of the wear liner is made of about 95% castable thermosetting urethane and about 5% graphite powder by weight, and the sealing member (27) is made of castable thermosetting urethane, a protective skirt (45) covering the sealing member (27), and means attaching the protective skirt (45) to the car body center plate (47), said attaching means comprising a nylon cable tie (49) wrapped around an upper upright portion (45*a*) of the skirt, and an adhesive layer (51) connecting said upright portion to the car body center plate.

* * * * *